US006877828B2

(12) United States Patent
Strong

(10) Patent No.: US 6,877,828 B2
(45) Date of Patent: Apr. 12, 2005

(54) UNDER STAIR STORAGE SHELF SYSTEM

(76) Inventor: Kline Strong, 2015 Highland Downs La., Salt Lake City, UT (US) 84117-7027

( * ) Notice: Subject to any disclaimer, the term of this patent is extended or adjusted under 35 U.S.C. 154(b) by 0 days.

(21) Appl. No.: 10/317,543

(22) Filed: Dec. 10, 2002

(65) Prior Publication Data

US 2003/0107306 A1 Jun. 12, 2003

Related U.S. Application Data

(60) Provisional application No. 60/339,638, filed on Dec. 11, 2001.

(51) Int. Cl.[7] ..... B62B 11/00; A47B 46/00; A47D 83/00

(52) U.S. Cl. ..... 312/249.8; 312/249.13; 312/235.1; 280/47.35

(58) Field of Search ..... 108/30, 50.11, 108/90, 92, 93, 101, 189, 193, 186, 180; 312/249.8, 249.13, 235.1; 280/47.35, 47.34

(56) References Cited

U.S. PATENT DOCUMENTS

| | | | | | |
|---|---|---|---|---|---|
| 2,443,236 | A | * | 6/1948 | Gallagher | 280/47.35 |
| 3,627,397 | A | | 12/1971 | Rominsky | |
| 3,870,333 | A | | 3/1975 | Burdick et al. | |
| 4,094,526 | A | | 6/1978 | Clarke et al. | |
| 4,373,761 | A | * | 2/1983 | Hansberry, Jr. | 312/249.12 |
| 4,512,591 | A | * | 4/1985 | Plante | 280/47.35 |
| 5,507,507 | A | | 4/1996 | Davidson | |
| D401,778 | S | | 12/1998 | Frias | |
| 5,899,469 | A | | 5/1999 | Pinto et al. | |
| 6,394,325 | B1 | * | 5/2002 | Taylor | 224/274 |
| 6,497,423 | B1 | * | 12/2002 | Perelli et al. | 280/47.34 |
| 6,502,838 | B1 | * | 1/2003 | Kresse et al. | 280/47.35 |
| 6,651,993 | B1 | * | 11/2003 | Emerzian et al. | 280/47.34 |
| 2002/0109318 | A1 | * | 8/2002 | Calmeise et al. | 280/47.35 |
| 2002/0148799 | A1 | * | 10/2002 | Denny et al. | 211/186 |
| 2003/0107195 | A1 | * | 6/2003 | Zambanini et al. | 280/47.34 |

FOREIGN PATENT DOCUMENTS

| | | | | |
|---|---|---|---|---|
| GB | 2189198 | A | * 10/1987 | B62B/3/02 |

OTHER PUBLICATIONS

Utility Cart Assembly Instructions Model No. 5800/5805, Continental Manufacturing Company, 40378716 Rev. May 1997.

* cited by examiner

*Primary Examiner*—Peter M. Cuomo
*Assistant Examiner*—Sarah C. Burnham
(74) *Attorney, Agent, or Firm*—Thorpe North & Western LLP

(57) ABSTRACT

A storage shelf system for efficiently storing goods in the irregularly shaped area under a flight of stairs. The horizontal shelves include a narrow shelf on top and a deep shelf on the bottom, with any number of shelves with intermediate depths between, such that a line connecting the rearward ends of the shelves forms an angle that corresponds to the underside of the flight of stairs. The storage shelf system includes a handle and wheels for easily maneuvering the shelf system beneath and withdrawing it from under the flight of stairs, webbing for securing goods to the shelf system, fixed undershelves for storing long, thin objects, slidable undershelves for temporarily storing goods while retrieving other goods from the storage shelf system, a fire-proof safe for securely storing valuable or potentially dangerous goods, and advantageously shape shelf compartment inserts for efficiently utilizing substantially all available storage space.

20 Claims, 5 Drawing Sheets

UNDER STAIR STORAGE SHELF SYSTEM

Priority of application Ser. No. 60/339,638 filed Dec. 11, 2001 in the United States Patent Office is hereby claimed.

BACKGROUND OF THE INVENTION

1. Field of the Invention

The present invention relates generally to a movable storage shelf system for use under a flight of stairs, with shelves configured to efficiently utilize the available storage space under the stairs by conforming to the slope of the underside of the stairs.

2. Related Art

Shelving systems have been utilized for many years for more efficient use of space required for storing goods. A standard set of shelves generally consists of a series of horizontal platforms supported by vertical supports. Standard shelving systems work well in locations where ample space exists to access the goods stored on the shelves. However, in locations where accessing the goods is difficult due to obstructions, or in small, cramped locations, standard shelves are less convenient because of the limited ease with which goods can be stored and retrieved.

Ready access to stored goods is an essential element for a practical storage system. Such a system should provide access for unimpeded placement and retrieval of stored materials, and also visual access for quick identification and location of such goods. Without convenient visual access, stored items can be forgotten and essentially lost until removal of other materials generally reveals the otherwise hidden item. Because of this, some locations which would otherwise be ideal for storage are purposefully neglected.

One such category of potential storage space which is generally discounted is the narrow and deep area under a stair case. Such a space is generally enclosed by opposing side walls and an inclined ceiling which comprises the underside of the stair case, or a finished surface. The space is typically enclosed as a closet, with a door opening under the upper-most stairs and the space converging to the rear of the closet under the lower-most stairs. Due to the slope of the underside of the stairwell, the resulting closet appears from the side as a triangle, with the greatest amount of storage space toward the front of the closet and the least amount toward the rear.

Sets of fixed shelves have been built within the closet space under flights of stairs, but the result is often undesirable. Such shelves would stand along one of the side walls, allowing a walkway along the opposing wall to permit access to stored goods. To simply fill the space with shelving materials would be impractical because upper shelves would be very shallow and lower shelves would be too deep where the rear of the shelves conforms to the sloping rear wall. Although the lower shelves would have the most space for storage, that storage space would be essentially unusable, due to the distance from the front to the rear of the shelf, where the shelf terminates against the underside of the bottom tread of the flight of stairs. Such a system of shelves is not desirable because a person retrieving goods from the rear areas of the lower shelves must climb into the shelves in order to reach the rear goods.

Where shelves have been constructed that do not fill the entire width of the closet, leaving room for a person to enter the closet to retrieve goods stored in the rear of the shelves, much of the available storage space under the flight of stairs remains unused, preserved as access space. Accordingly, there has been little purposeful use of the full storage space enclosed by a closet under the stair case structure.

SUMMARY OF THE INVENTION

It has been recognized that it would be advantageous to develop a system of shelving for use under a flight of stairs that efficiently utilizes all of the available storage space while allowing easy access to all of the goods stored thereon.

The present invention provides a movable, under stair storage shelf system for efficiently storing goods under a flight of stairs. In accordance with one aspect of the present invention, the storage shelf system includes horizontal shelves with differing depths, supported by vertical support members of differing heights. The shelf system advantageously includes shelves with depths differing such that the rear ends of the shelves fall on a line which forms an angle that conforms to the slope of the underside of the flight of stairs. Similarly, the heights of the vertical supports would correspond to floor-to-stair runner heights in decreasing lengths. Wheels attached to either the bottommost shelf or the vertical support frame allow the shelf system to be movable. Front wheels can preferably rotate about a vertical axis while rear wheels are fixed for movement in a linear path, allowing the user some control of the course of the shelf system while maneuvering it beneath and withdrawing it from under the flight of stairs.

In accordance with another aspect of the present invention, the shelf system advantageously includes a slidable undershelf mounted beneath and proximate to any of the horizontal shelves. Preferably, the slidable undershelf is configured to be extended for temporary storage of goods which must be moved from the horizontal shelves in order to access other goods on the horizontal shelves.

In accordance with another aspect of the present invention, the shelf system includes a fixed undershelf or support bracket mounted beneath and proximate to any of the horizontal shelves, configured for storage of long, thin objects. Preferably, the fixed undershelf is more narrow than the vertical support members or the distance between the wheels, as the case may be, so that items stored on the fixed undershelf are prevented from projecting out of the sides of the shelf system.

In accordance with another aspect of the present invention, the shelf system includes flexible webbing, configured to secure goods to the shelf system or to prevent them from falling while the shelf system is positioned beneath or withdrawn from under the flight of stairs. Advantageously shaped shelf inserts can also be removably attached to the horizontal shelves to further utilize all available storage space. Storage hooks preferably are attached to the sides of the shelf system to further utilize the available storage space.

In accordance with another aspect of the present invention, the shelf system advantageously includes a fireproof safe welded to the frame beneath one of the horizontal shelves, for securely storing valuable or potentially dangerous goods. Additional features and advantages of the invention will be apparent from the detailed description which follows, taken in conjunction with the accompanying drawings, which together illustrate, by way of example, features of the invention.

DETAILED DESCRIPTION

Figure 1:
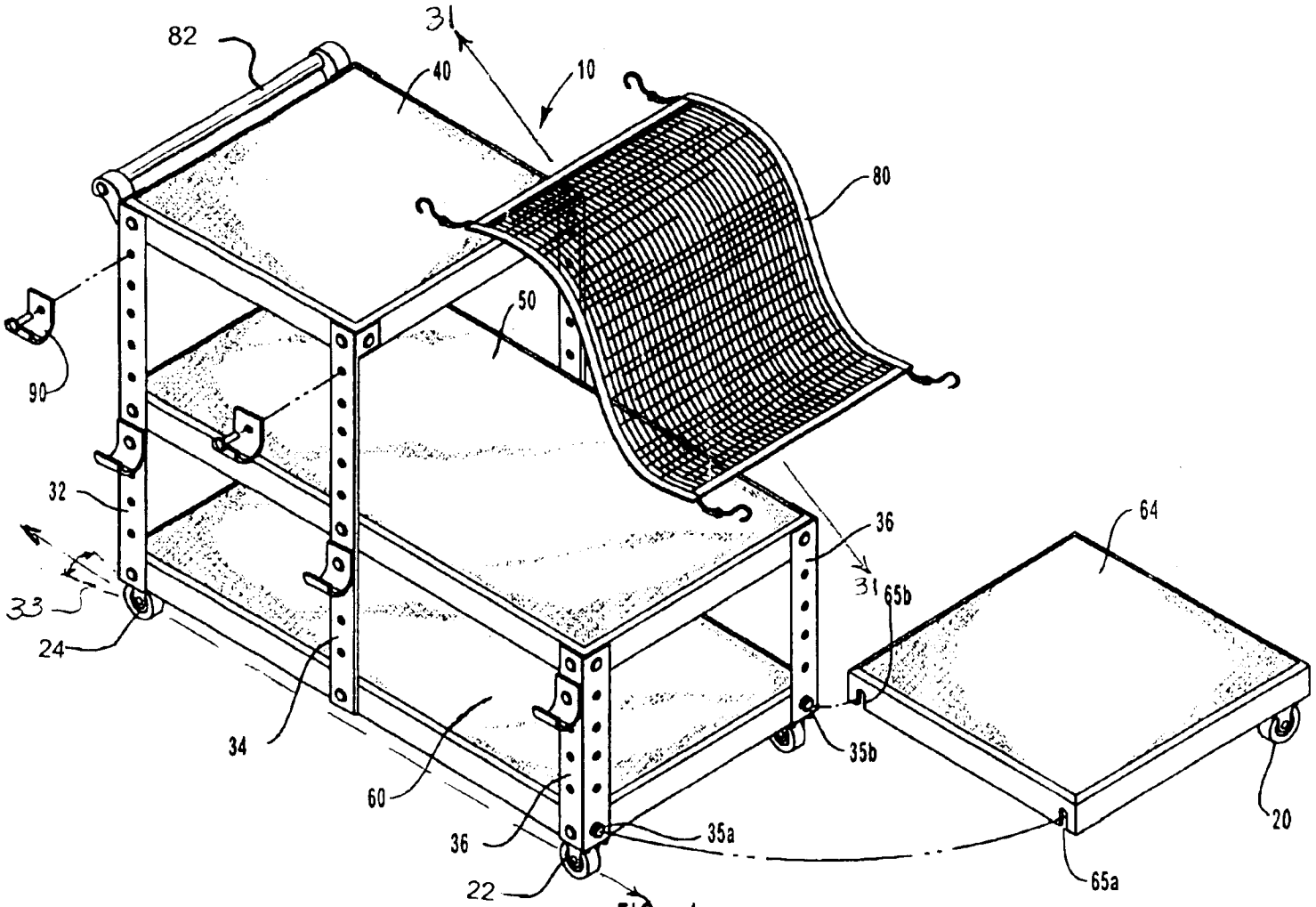
FIG. 1 is a semi-exploded perspective view of a preferred embodiment of an under stair storage shelf system in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 2:
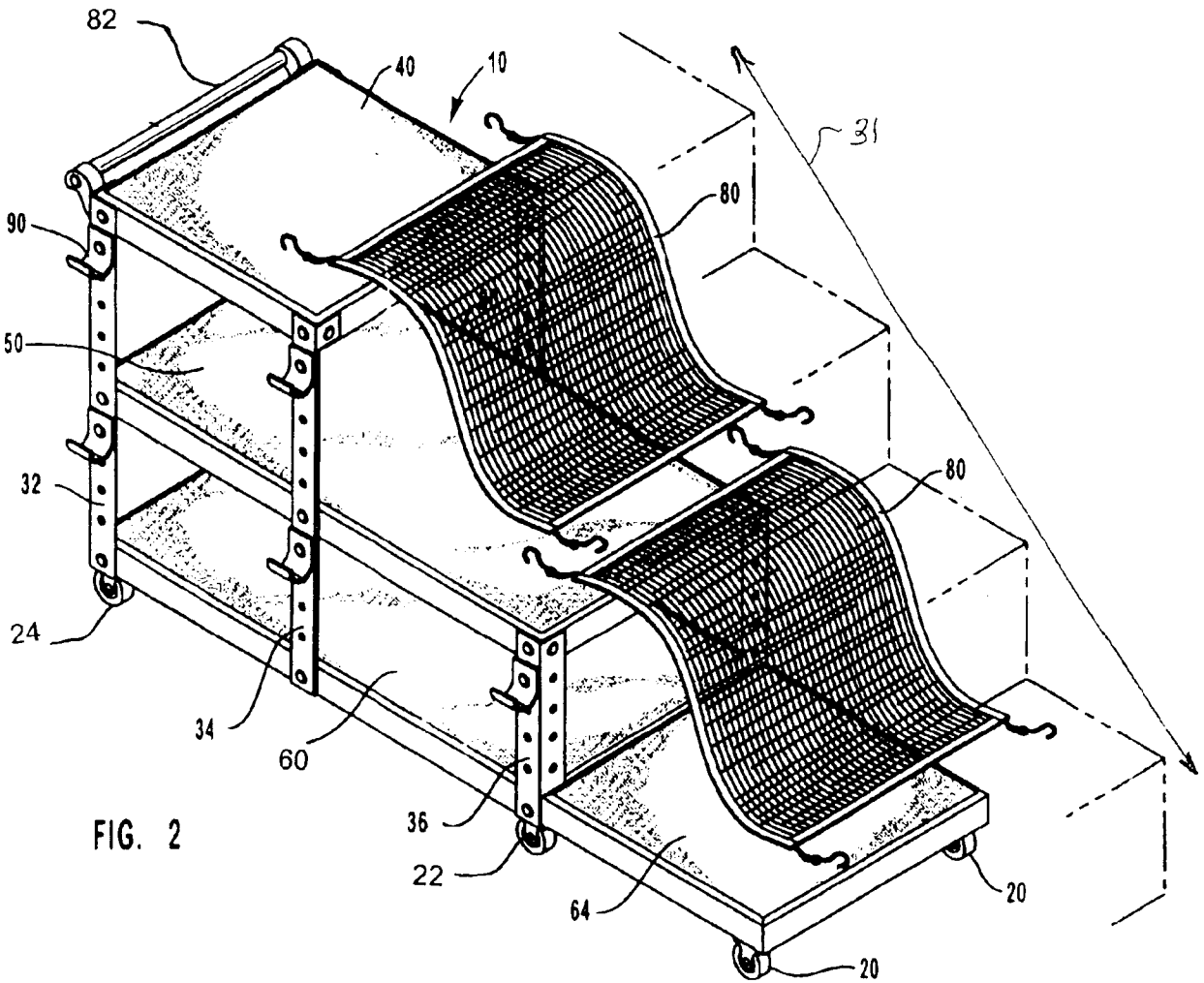
FIG. 2 is perspective view of a preferred embodiment of an under stair storage shelf system in accordance with the present invention.

Referring now to FIGS. 1–5, wherein like referenced numerals refer to like parts throughout, the under stair storage shelf system shown in FIGS. 1 and 2, denoted generally at 10, includes an array of horizontal shelves 40, 50 and 60, with depths that differ such that the rear ends of the shelves are positioned along an inclination 31 which approximately conforms to the underside of a flight of stairs. Vertical support members 32, 34 and 36 support the horizontal shelves, and wheels 20, 22 and 24 allow the shelf system to be moved beneath and withdrawn from under the flight of stairs. The respective heights of the vertical support members 34 and 36 differ to accommodate the inclination of the storage area. Vertical support members 32 and 34 are of common height to support shelf 40 in a level configuration.

Referring now more particularly to FIGS. 1 and 2, a preferred embodiment of the present invention is shown generally at 10. The horizontal shelves 40, 50 and 60 are secured to the vertical support members 32, 34 and 36. While FIGS. 1 and 2 show three horizontal shelves, any number of shelves could be added to increase the available shelf space, or as few as two might alternately be used. Also, the number of vertical support members could be increased or decreased as is necessary to support the selected number of shelves, as well as the weight of the goods stored on the shelves. The horizontal shelves and vertical support members are configured to allow at least two-sided access to the goods stored on the shelf system once the system is withdrawn from under the flight of stairs. FIG. 2 shows a possible configuration of a set of stairs and how the present invention might be located in relation to the inclination 31 of the flight of stairs.

Figure 3:
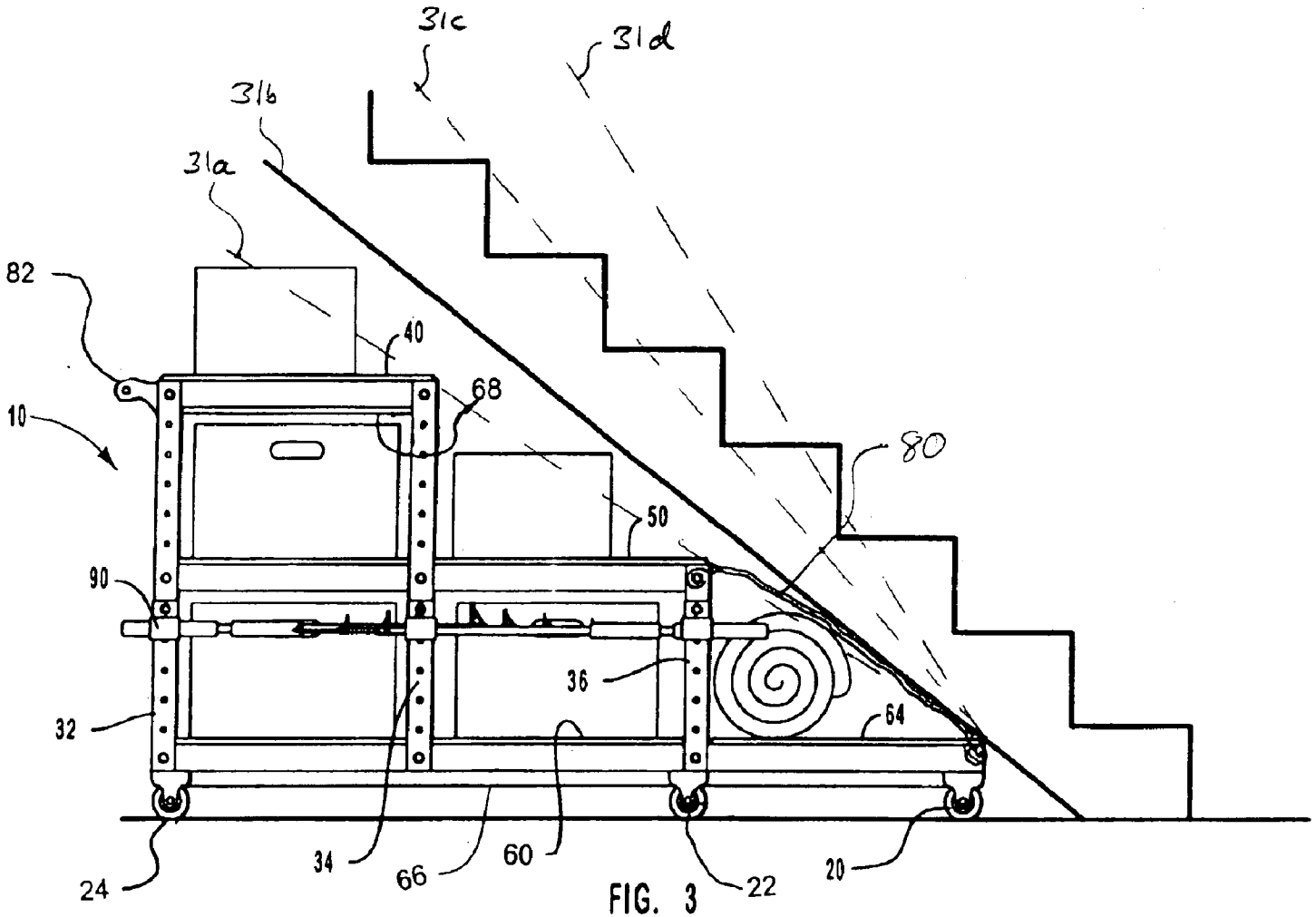
FIG. 3 is a side elevational view of the present invention, as viewed through the wall of an under stair closet.
Figure 4:
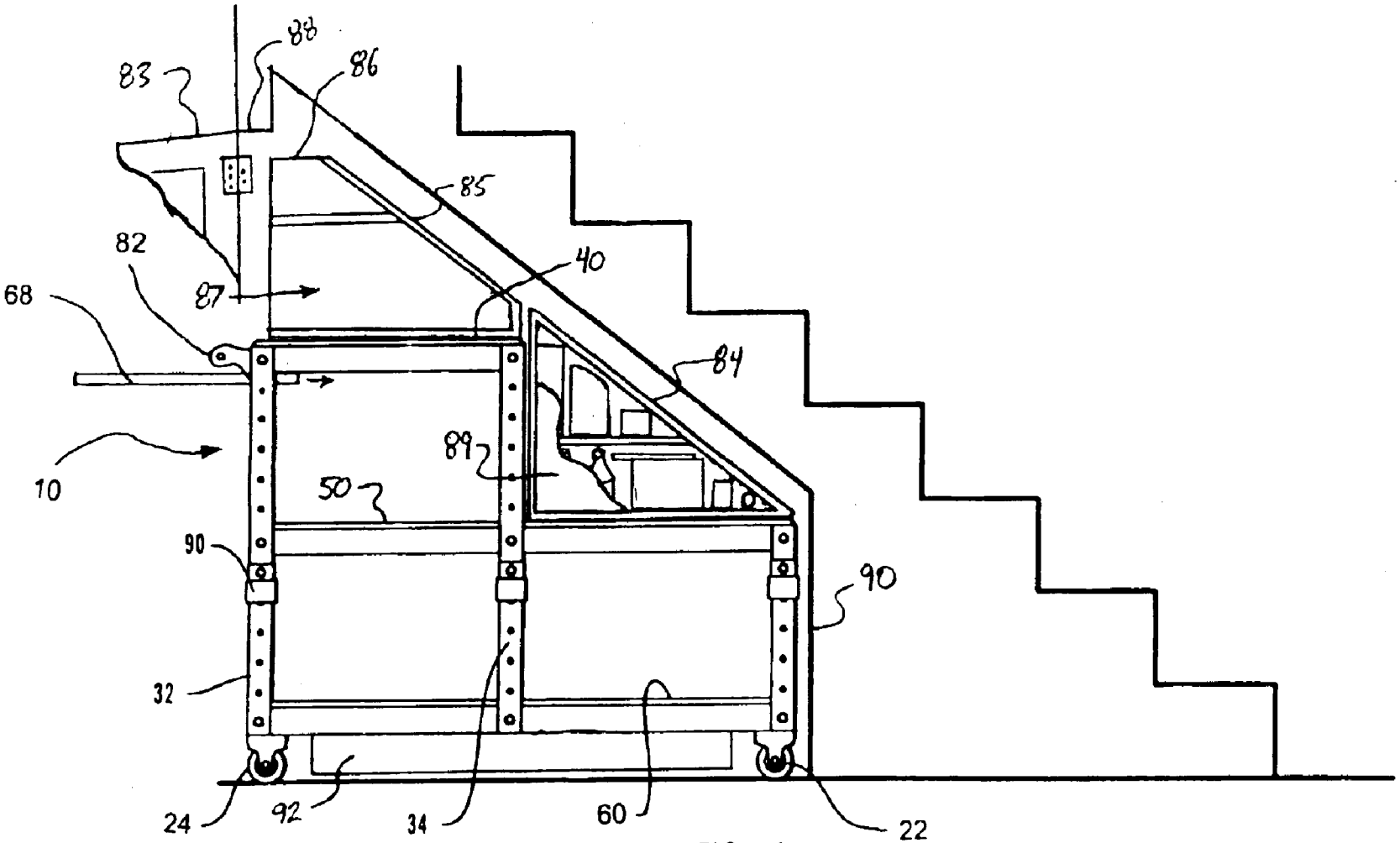
FIG. 4 is an elevational view of an alternate embodiment of the present invention, as viewed through the wall of an under stair closet.

The bottom shelf 60 is shown in FIG. 1 with a depth equal to that of the shelf directly above it. This allows for the attachment of an optional, removable end shelf 64, which can extend to the bottommost point of the rear stair wall. The removable end shelf 64 can include slots 65*a* and 65*b*, which correspond respectively to pins 35*a* and 35*b*, located on the bottom shelf 60. A set of wheels 20 can be added to the rear of the removable end shelf 64 for further support and mobility. In this embodiment of the present invention, the storage shelf system can be used in a wedged-shaped closet as depicted in FIG. 3, with removable end shelf 64 attached. The system can also be used in a closet with a truncated rear wall, as depicted in FIG. 4, without removable end shelf 64 attached. The bottom shelf 60 can also be constructed to extend the entire depth of the closet as one piece, without utilizing the removable end shelf 64.

Wheels 20, 22 and 24, shown in FIGS. 1–3, can be attached to either the underside of the bottom shelf 60 or the underside of the vertical support members 32, 34 and 36. In a preferred embodiment of the present invention, the rear wheels 20 are fixed about a vertical axis, allowing only linear movement in a backward and forward direction to and from the storage area. The middle wheels 22 add further support to the shelf system and provide directional stability to the rear wheels 20 to assist in movement into and out of the storage area in a straight line.

The front wheels 24 are free to rotate about a vertical axis, and allow the user to control the direction of the shelf system as it is being maneuvered beneath or withdrawn from under the flight of stairs. The preferred embodiment incorporates limited rotation 33 of front wheels 24 within a range of plus or minus 10 to 20 degrees. This configuration is beneficial in that once the shelf system is directed into the closet it will roll in a straight path, avoiding damage to either the walls of the closet or any goods stored on the outside edges of the shelf system. Nevertheless, removal of the system from the storage area offers some degree of rotation once the system has cleared the narrow side wall enclosure. Alternately, any of the wheels can be fixed, rotatable, or a combination of the two. Likewise, wheels that can be variably fixed or rotatable can also be used in any of wheel locations.

Sections of flexible webbing 80 with attachable hooks, shown in FIGS. 1, 2 and 3, can be used to secure stored goods in place and prevent them from falling as the shelf system is maneuvered beneath or withdrawn from under the flight of stairs. Storage hooks or brackets 90 can be attached to the sides of the shelves or the vertical support members to increase the available storage area. The storage hooks 90 can be used collectively to support elongate goods, such as fishing poles, guns or pool cues, which might rest upon two or more hooks. In addition, they can be used singularly as hooks from which individual items can be suspended.

As shown in FIG. 3, the shelves 40, 50 and 60 and the vertical support members 32, 34 and 36 are configured such that the ends of the shelves terminate along an inclination typified by sample inclinations 31*a*, 31*b*, 31*c* and 31*d* in FIG. 3. The inclination will vary from system to system due to the various inclinations formed by the undersides of flights of stairs. Inclination 31*a* depicts a lower extreme of approximately 30 degrees, with inclination 31*d* depicted an upper extreme of approximately 60 degrees. Inclinations 31*b* and 31*c* represent intermediate angles of approximately 40 and 50 degrees, respectively.

FIG. 3 also shows in its retracted position a slidable undershelf 68, mounted beneath shelf 40. FIG. 4 shows the slidable undershelf 68 in its extended position. Slidable shelf 68 can be used to either store items that can be retrieved by extending the shelf 68, or can be left empty and used as a temporary storage shelf for temporarily placing goods when retrieving other goods from the fixed horizontal shelves. In this manner, any goods that might have to be moved in order to access other goods can be temporarily stored on the slidable shelf and then replaced after retrieval of the desired goods.

FIG. 4 shows an alternate embodiment of the present invention, for use under a stairwell with a truncated rear wall 90. All of the foregoing advantageous features are present to efficiently utilize the available storage space. In this embodiment, the rear wheels 22 can be fixed about a vertical axis, while the forward wheels 24 can be allowed to rotate about a vertical axis as shown in FIG. 1, allowing for greater maneuverability of the shelf system as it is moved beneath or withdrawn from under the flight of stairs. The wheels alternately can be fixed, rotatable, or a combination of the two. Wheels that can be variably fixed or rotatable can also be used in any of the wheel locations.

Advantageously shaped shelf compartments or inserts 84 and 86 are also shown in FIG. 4. By designing the shape of the shelf inserts to conform to the inclination of the underside of the flight of shelves, substantially all of the usable storage space on the shelves can be utilized. Shelf insert 84 is an example of a triangularly shaped insert, shown in FIG. 4 with representative goods that can be stored on insert 84. Such a shape can be used in shelf locations directly beneath the under side of the flight of stairs. Flexible side covers 89, shown in a cut-away view, can also be attached to the inserts to prevent items from falling out of the shelf inserts as the shelf system is maneuvered beneath or withdrawn, from under the flight of stairs. The flexible covers can be constructed of cloth or other adjustable material, so that the flexible covers can be easily lifted away from the lateral access openings in the shelf inserts for conveniently storing, viewing and accessing the goods.

Where necessary, shelf compartment inserts such as insert 85 can be used to efficiently utilize the greatest amount of available storage space while maintaining the ability of the shelf system to roll freely under the flight of stairs without dislodging any stored goods. For example, shelf insert 85 is truncated at 86 so that the insert will not contact the doorframe 88 while being placed beneath or removed from under the flight of stairs. Insert 85 is configured so that the stored goods can be accessed from the side of the insert exposed when the shelf system is withdrawn from under the stairs. Goods in insert 85 can also be accessed from the front of the system at 87. This configuration is advantageous in that frequently accessed items can be stored on insert 85 and retrieved without removing the shelf system from under the flight of stairs. The shelf inserts can be used with any embodiment of the present invention.

Figure 5:
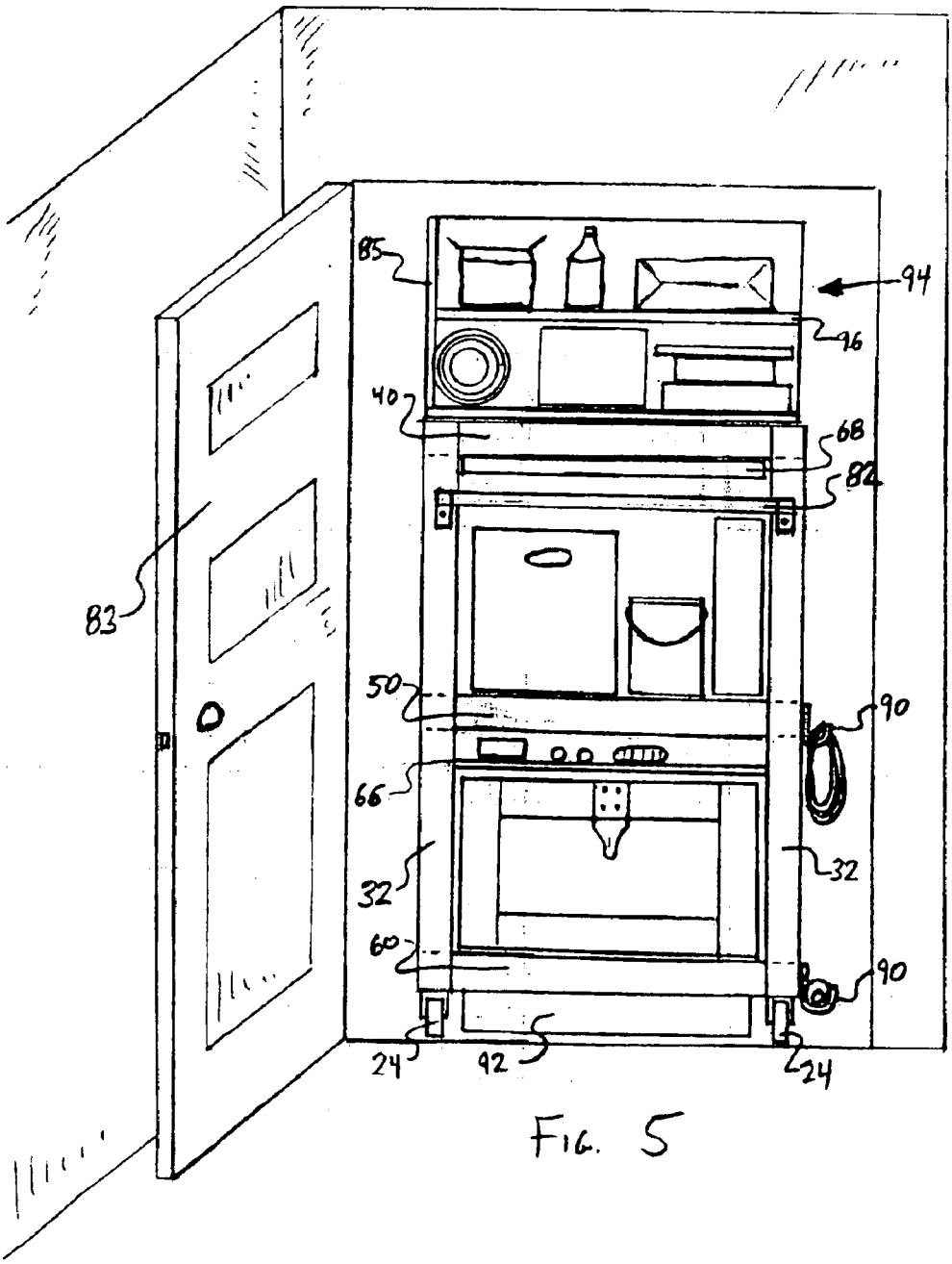
FIG. 5 is an end elevational view of a preferred embodiment of the present invention, as viewed through the open door of an under stair closet.

Shown in FIGS. 4 and 5 is a fire-proof safe 92. In a preferred embodiment, the fireproof safe is welded to the frame of the shelf system. Welding the safe to the frame provides increased theft deterrent in that removal of the safe from the premises would require removal of the entire shelf system frame. Positioning the shelf below the bottom shelf helps to conceal the existence of the safe. The safe can be constructed so as to enable storage of rifles or other long guns in order to protect them from theft and to prevent access to them by children or other unintended users. By using a fire-proof safe, the shelf storage system can also be used to store valuable items that would otherwise be destroyed in the event of a fire. The fire-proof safe can also be used in any of the foregoing embodiments, and can be attached by means other than welding, as would occur to one skilled in the art.

FIG. 5 shows an end view of the storage shelf system stored under a flight of stairs, as it would appear looking through the open door 83. Representative items that can be stored on the shelf system are also shown. All of the foregoing advantages and features are present, as well as a fixed horizontal undershelf 66 shown attached beneath shelf 50. This additional fixed undershelf, which in this embodiment has a width less than the distance between the vertical support members 32, can be used to store long, thin goods such as guns or fishing poles. By confining the fixed undershelf 66 between the vertical support members, items are prevented from falling off or protruding out of the shelf system. The fixed undershelf can also be located under the other horizontal shelves. When located under the lower shelf, the undershelf is confined between the wheels to prevent items from falling off or protruding out of the shelf system.

Shelf compartment insert 85 is also shown in FIG. 5 with representative items that can be stored on the insert. By advantageously including in insert 85 an intermediate horizontal shelf 96, additional goods can be stored in the space above the items stored on the bottom of insert 85. Because the front of insert 85 is left open, goods can be stored on and retrieved from the insert without removing the shelf system from the closet, making insert 85 an ideal location for storing frequently accessed items. Shelf insert 85 is also left open on the side so that goods can be accessed from 94, as shown in FIG. 5, once the system is removed from under the flight of stairs.

FIG. 5 also shows an end view of the slidable undershelf 68 and the fire-proof safe 92. Representative goods are shown stored on and suspended from storage hooks 90. It will be appreciated that by advantageously including fixed rear wheels 20 and 22, and rotatable front wheels 24, the shelf system can be accurately maneuvered beneath and withdrawn from under the flight of stairs without damaging the goods stored on storage hooks 90. Damage to the door frame or closet walls is also limited.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A storage shelf system for efficiently storing goods in an enclosed area under a flight of stairs, the storage shelf system comprising:

a) a movable frame, including vertical support members, said frame being configured to be removably disposed under the flight of stairs;

b) wheels coupled to the frame;

c) a vertical array of at least three horizontal shelves mounted to the vertical support members, including at least a deep bottom shelf, a shallow top shelf, and at least one intermediate depth shelf intermediate shelf being positioned vertically between the bottom shelf and the top shelf;

d) the at least three shelves each having a width, a forward edge, a rearward edge, and a depth extending between the forward and rearward edges;

e) a removable horizontal end shelf having a forward edge, a rearward edge, and a depth therebetween;

f) the forward edges of the at least two shelves being substantially aligned in a vertical plane; and f) wherein the depths of the at least three shelves and the removable shelf differ from a greater depth of the combined depths of the bottom shelf and the removable end shelf to a lesser depth on the top shelf, such that a line connecting the rearward edge of the top shelf, the rearward edge of the at least one intermediate shelf, and the rearward edge of the removable end shelf defines an angle of between 30 and 60 degrees measured from the bottom shelf.

2. The storage shelf system of claim 1, further comprising:

a) forward wheels coupled substantially near the forward edge of the bottom shelf;

b) rearward wheels coupled substantially near the rearward edge of the bottom shelf;

c) middle wheels coupled between the forward and rearward wheels;

d) the forward wheels including pivotal wheels capable of pivoting about a vertical axis; and e) the middle and rearward wheels being fixed about a vertical axis for movement in a common direction.

3. The storage shelf system of claim 1, further comprising at least one slidable undershelf, slidably mounted beneath and proximate to at least one of the at least three horizontal shelves.

4. The storage shelf system of claim 1, further comprising at least one fixed undershelf, mounted beneath and proximate to at least one of the removable end shelf, the at least one intermediate shelf and the top shelf; the fixed undershelf configured to store and protect long, thin objects.

5. The storage shelf system of claim 1, further comprising flexible webbing, removably attached between the rearward edges of the at least two horizontal shelves, the webbing being configured to secure items stored on the shelves.

6. The storage shelf system of claim 1, further comprising at least one storage hook coupled to the frame and configured to suspend items from the frame.

7. The storage shelf system of claim 1, further comprising a handle coupled to the frame at the forward edges of the horizontal shelves and configured to allow a user to maneuver the storage shelf system to and from a storage location.

8. The storage shelf system of claim 1, further comprising a fire-proof safe, coupled to the movable frame beneath one of the at least three horizontal shelves, the fire-proof safe being configured to protect valuable items from theft and fire damage.

9. The storage shelf system of claim 1, further comprising at least one shelf compartment insert removably positioned on a top of at least one horizontal shelf, the at least one shelf insert comprising:

a) a horizontal bottom member;

b) a sloped top member coupled to the horizontal bottom member, the sloped top member being configured to approximately conform to a slope of an underside of the flight of stairs;

c) at least one vertical support member, coupled to the horizontal bottom member and the sloped top member to form a storage compartment; and d) at least one horizontal intermediate shelf member, coupled above the bottom member to the at least one vertical support member and the sloped top member.

10. A storage shelf system for efficiently storing goods under a flight of stairs, the storage shelf system comprising:

a) a movable frame having vertical support members, the frame being configured to be removably disposed under a flight of stairs;

b) wheels coupled to the frame;

c) a vertical array of at least three horizontal shelves mounted to the vertical support members, including at least a deep bottom shelf, a shallow top shelf, and at least one intermediate depth shelf, the intermediate shelf being positioned vertically between the bottom shelf and the top shelf;

d) the at least three shelves each having a width, a forward edge, a rearward edge, and a depth extending between the forward and rearward edges;

e) a removable horizontal end shelf having a forward edge, a rearward edge, and a depth therebetween;

f) the forward edge of the removable end shelf being removably attached at the rearward edge of the bottom shelf such that both are in a substantially horizontal plane when attached; and g) wherein the depths of the at least three shelves and the removable shelf differ from a greater depth of the combined depths of the bottom shelf and the removable end shelf to a lesser depth on the top shelf, such that a line connecting the rearward edge of the top shelf, the rearward edge of the at least one intermediate shelf, and the rearward edge of the removable end shelf defines an angle of between 30 and 60 degrees measured from the bottom shelf.

11. The storage shelf system of claim 10, further comprising at least one wheel, coupled to the removable end shelf.

12. The storage shelf system of claim 10, further comprising:

a) forward wheels, coupled substantially near the forward edge of the bottom shelf;

b) rearward wheels coupled substantially near the rearward edge of the removable end shelf;

c) middle wheels coupled substantially near the rearward edge of the bottom shelf;

d) the forward wheels including pivoting wheels capable of pivoting about a vertical axis; and e) the middle and rearward wheels being fixed about a vertical axis for movement in a common direction.

13. The storage shelf system of claim 10, further comprising at least one slidable undershelf, slidably mounted beneath and proximate to the forward edge of at least one of the at least three shelves.

14. The storage shelf system of claim 10, further comprising at least one fixed undershelf, mounted beneath and proximate to at least one of the at least three horizontal shelves, the fixed undershelf configured to store and protect long, thin objects.

15. The storage shelf system of claim 10, further comprising flexible webbing, removably attached between the rearward edges of the removable end shelf, the at least one intermediate shelf and the top shelf, the webbing being configured to secure items stored on the shelves.

16. The storage shelf system of claim 10, further comprising at least one storage hook coupled to the frame and configured to suspend items from the frame.

17. The storage shelf system of claim 10, further comprising a handle coupled to the frame at the forward edges of the horizontal shelves and configured to allow a user to maneuver the storage shelf system to and from a storage location.

18. The storage shelf system of claim 10, further comprising a fire-proof safe coupled to the movable frame beneath one of the at least three horizontal shelves, the fire-proof safe being configured to protect valuable items from theft and fire damage.

19. The storage shelf system of claim 10, further comprising at least one shelf compartment insert removably positioned on a top of at least one horizontal shelf, the at least one shelf insert comprising:

a) a horizontal bottom member;

b) a sloped top member coupled to the horizontal bottom member;

c) a sloped top member being configured to approximately conform to a slope of an underside of the flight of stairs;

d) at least one vertical support member coupled to the horizontal bottom member and the sloped top member to form a storage compartment; and e) at least one horizontal intermediate shelf member coupled above the bottom member to the at least one vertical support member and the sloped top member.

20. A storage shelf system, comprising:

a) a vertical array of at least three horizontal shelves having different front to back depths;

b) a deep bottom shelf;

c) a shallow top shelf;

d) a middle shelf having an intermediate depth greater than the depth of the top shelf and less than the depth of the bottom shelf; and e) wheels coupled to the bottom shelf, configured to allow the array of shelves to be movable;

f) a removable horizontal end shelf having a forward edge, a rearward edge, and a depth therebetween; and has been inserted; and g) wherein the depths of the at least three shelves and the removable shelf differ from a greater depth of the combined depths of the bottom shelf and the removable end shelf to a lesser depth on the top shelf, such that a line connecting the rearward edge of the top shelf, the rearward edge of the at least one intermediate shelf, and the rearward edge of the removable end shelf defines an angle of between 30 and 60 degrees measured from the bottom shelf.

* * * * *